US006789740B2

(12) United States Patent
Osler

(10) Patent No.: US 6,789,740 B2
(45) Date of Patent: Sep. 14, 2004

(54) RAIL MOUNTING ASSEMBLY

(75) Inventor: Wilbur F. Osler, Mattituck, NY (US)

(73) Assignee: Advanced Track Products, LLC, Mattituck, NY (US)

( * ) Notice: Subject to any disclaimer, the term of this patent is extended or adjusted under 35 U.S.C. 154(b) by 0 days.

(21) Appl. No.: 10/287,424

(22) Filed: Nov. 4, 2002

(65) Prior Publication Data

US 2003/0084813 A1 May 8, 2003

Related U.S. Application Data

(60) Provisional application No. 60/332,850, filed on Nov. 6, 2001.

(51) Int. Cl.[7] ..... E01B 9/29

(52) U.S. Cl. ..... 238/264; 238/283

(58) Field of Search ..... 238/283, 264, 238/382, 320, 306, 307, 312; 105/199.3, 218.1, 220, 225, 230

(56) References Cited

U.S. PATENT DOCUMENTS

| | | | | |
|---|---|---|---|---|
| 4,577,801 A | * | 3/1986 | Ortwein | 238/283 |
| 4,715,533 A | * | 12/1987 | Bucksbee et al. | 238/283 |
| 4,915,298 A | * | 4/1990 | Ortwein | 238/283 |
| 5,165,598 A | * | 11/1992 | Ortwein | 238/283 |
| 5,361,986 A | * | 11/1994 | Meier et al. | 238/283 |

* cited by examiner

*Primary Examiner*—Frantz F. Jules
(74) *Attorney, Agent, or Firm*—Herbert Dubno

(57) ABSTRACT

Rail mounting assembly of the type in which a top plate is secured to a frame by an elastomer body surrounding the top plate and bonded to both the top plate and the frame. The rounded ends of the top plate and frame receive the elastomer in gaps between downwardly and inwardly inclined surfaces while the elastomer between the longitudinal flanks of the frame and top plate has downwardly open voids which are narrower toward the end of the top plate and wider at a midpoint.

14 Claims, 4 Drawing Sheets

RAIL MOUNTING ASSEMBLY

CROSS REFERENCE TO RELATED APPLICATION

This is a nonprovisional application corresponding to of copending provisional application 60/332,850 filed Nov. 6, 2001.

FIELD OF THE INVENTION

The present invention relates to a rail mounting assembly and, more particularly, to a rail mounting assembly of the type in which a metal frame is connected with the rail support platform by a body of an elastomer.

BACKGROUND OF THE INVENTION

Rail mounting assemblies in which the rail is supported on a suitable surface with an elastomeric material between a top plate and a frame and in which the elastomer is bonded to the top plate and the frame are known. However, in such assemblies, generally speaking the elastomer is subjected to cycles of compression and tension which cause deterioration of the elastomer or separation of the elastomer from the metal surfaces. Prior constructions, moreover, were prone to deterioration from poor ratios of dynamic to static stiffness, force distribution, unsatisfactory lateral to vertical stiffness, failure to minimize strain, fatigue failure, corrosion and were frequently unsatisfactory with respect to thermal contraction and expansion, and the ability for foreign material to collect in the unit or combinations thereof.

OBJECTS OF THE INVENTION

It is, therefore, the principal object of the invention to provide an improved rail mounting assembly whereby the drawbacks of earlier devices are avoided.

Another object of this invention is to provide an improved rail mounting assembly which is less susceptible to corrosion, is less affected by cyclic compression and tension and does not tend to collect foreign matter.

An important object is to provide a mounting assembly which has a unique ability to control the extent of transfer of forces at specific or desired locations, has a lower dynamic to static stiffness ratio, has reduced internal strain levels, and has improved resistance to under-bond corrosion.

SUMMARY OF THE INVENTION

These objects and others which will become apparent hereinafter are attained, in accordance with the invention, in a rail mounting assembly which comprises:

an elongated metal frame having a generally planar bottom surface adapted to rest upon a support, a pair of outwardly convex curved end members and a pair of mutually parallel longitudinal members, the members surrounding an opening of the frame, the end members having downwardly and inwardly inclined flanks delimiting the opening, the longitudinal members having flanks generally perpendicular to the bottom surface delimiting the opening;

an elongated top plate received in the opening in the frame and having an upper surface forming a platform for receiving a rail and formations flanking the platform for securing the rail on the platform, the top plate having a pair of outwardly convex curved ends spacedly juxtaposed with the end members and a pair of longitudinal sides spacedly juxtaposed with the longitudinal members, the ends having downwardly and inwardly inclined flanks forming respective gaps widening upwardly and downwardly with the downwardly and inwardly inclined flanks of the end members, the longitudinal sides having flanks defining respective gaps with the flanks of the longitudinal members; and a body of an elastomer received in the gaps, bonded to and fully covering the flanks and resiliently holding the frame and top plate together.

Advantageously, the elastomer in the gaps between the flanks along the longitudinal sides has downwardly open crevices extending the full lengths of the longitudinal sides which can close under load. These crevices can be narrower toward the ends of the longitudinal sides than at middle portions thereof.

The crevices or voids permit the distribution of the load or stress to maximize performance and durability.

According to another feature of the invention, the elastomer extends over the rounded tops of the ends of the top plate and into a trough or valley formed between each end and the rail receiving platform or the formations for securing the rail thereto.

The elastomer can also extend over the rounded edges of the frame members at the ends of the frame.

The system of the invention has numerous advantages of prior art systems. For example, by varying the thickness and configuration of the voids or crevices in the body of the elastomer, the transfer of longitudinal forces can be controlled between zero and an undiminished level. The variable thickness and configuration of the voids also permits controlling the amount of force transferred from the top plate to the frame at any location as desired.

Since, with the present invention, the ends of the top plate and the frame are encapsulated at least where the two are juxtaposed, the danger of corrosion between the elastomer and the metal surface at each location is limited. While corrosion can occur where the metal is exposed beyond the elastomer, this corrosion is sufficiently far from the active rubber under cyclic stress to reduce the risk of deterioration of the bonded surfaces.

The elastomer body of the invention lies essentially in a single horizontal plane and thus insures an effective seal which represents a significant advance over earlier bonded rail mounting systems. The curvature at the ends of the top plate and frame has been found to be significant as well in maximizing lateral stability and minimizing stress in the elastomer, thereby also maximizing the life of the mount. The curved end faces insure a large volume of elastomer between the end surfaces even with a minimum width of the frame and can contribute to the self centering properties of the mount.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
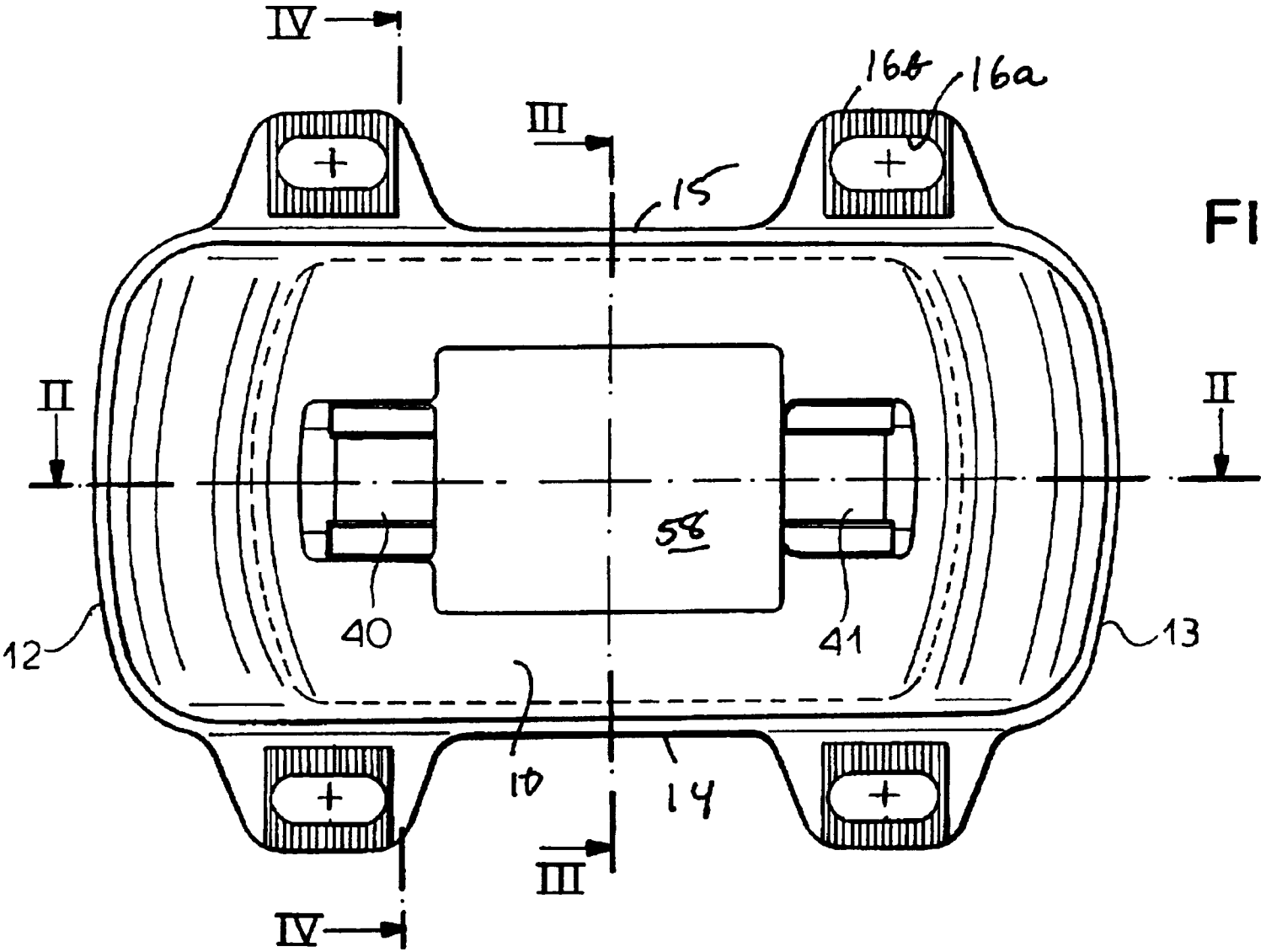
FIG. 1 is a top plan view of a rail mounting assembly according to the invention.

As can be seen from FIGS. 1 through 4, the rail mounting assembly of the invention comprises a top plate 10 and a frame 11 between which a body of an elastomer is disposed. The frame has relatively massive end members 12 and 13 which, as can be seen from FIG. 1, are convex outwardly and a pair of longitudinal members or sides 14 and 15 which are more slender. The frame has a bottom surface 11*a* adapted to rest upon a support for the rail and a central opening 11*b* in which the top plate is received. The frame is elongated and, as will be apparent from FIG. 3, the surfaces 14*a* and 15*a*, i.e. the inner flanks of the members 14 and 15, are substantially perpendicular to the bottom surface 11*a*.

The frame is provided with lateral wings or lugs 16 for receiving anchor bolts, each such lug or wing being provided with a slot 16*a* surrounded by an array of teeth 16*b*. Anchor bolts can pass through the anchor slots 16*a* and can be set in anchors in underlying concrete. The serations or teeth 16*b* permit lateral adjustment and prevent slipping of the mount.

Figure 2:
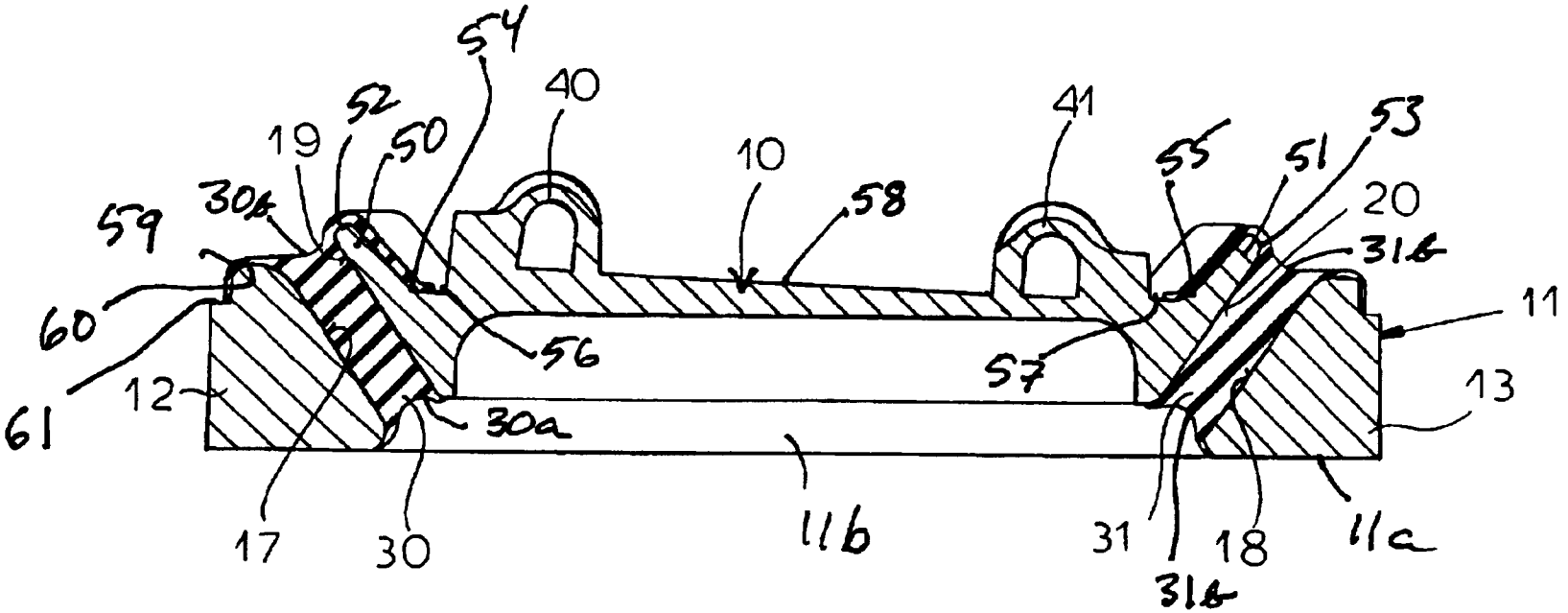
FIG. 2 is a cross sectional view taken along the line II—II of FIG. 1.
Figure 3:
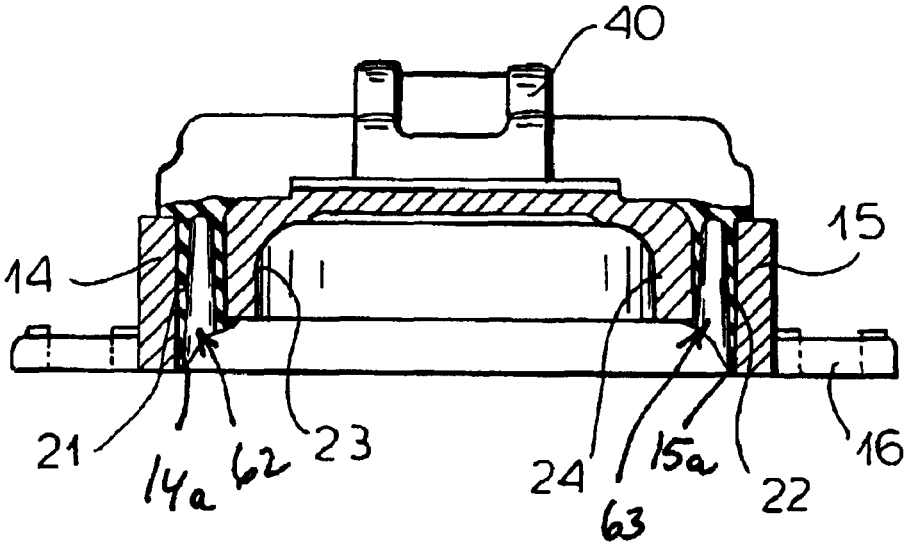
FIG. 3 is a cross sectional view taken along the line III—III of FIG. 1.
Figure 4:
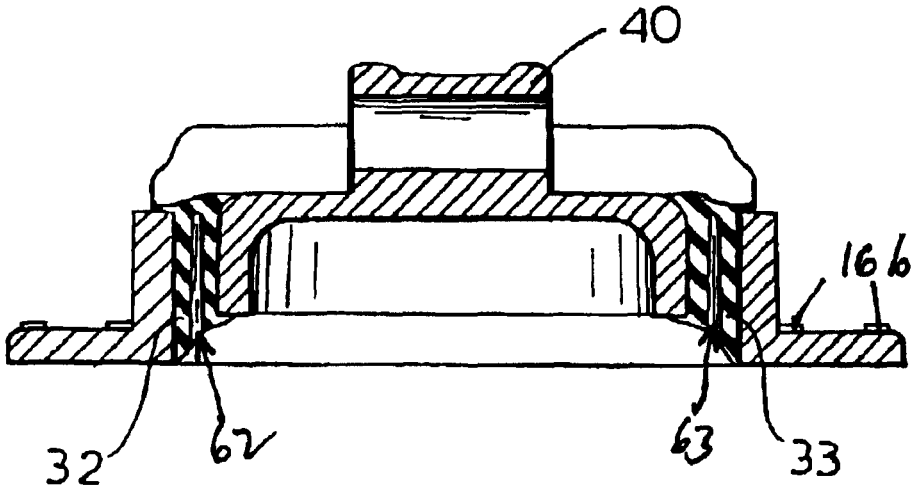
FIG. 4 is a cross sectional view taken along the line IV—IV of FIG. 1.
Figure 5:
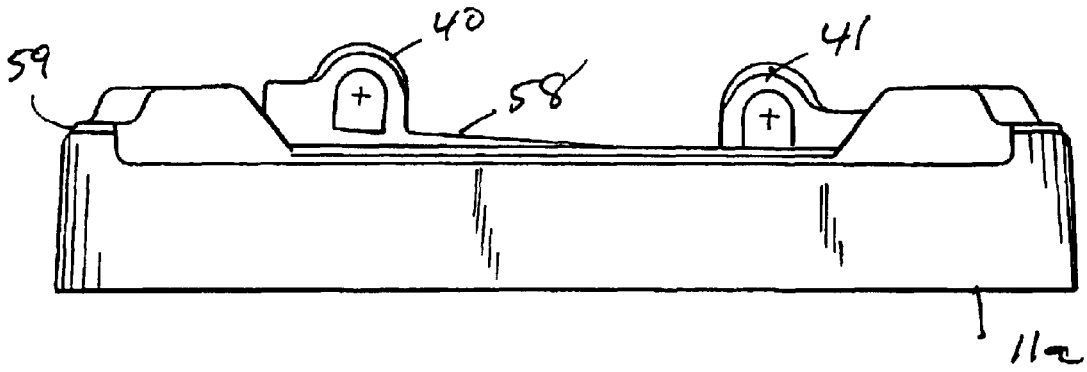
FIG. 5 is a side elevational view of the assembly with bottom wings or lugs.

The ends 12 and 13 as seen in FIG. 2, for example, have downwardly and inwardly inclined flanks 17 and 18 which confront downwardly and inwardly inclined flanks 19 and 20 of the top plate to create gaps 30 and 31 which flair outwardly on the upper and lower sides of the gap. These gaps are filled with the elastomeric material which is bonded to the flanks and which, at the upper and lower ends of the gap, define concavities 30*a* and 30*b* and 31*a* and 31*b*. The flanks are entirely covered and bonded to the elastomeric material.

In addition, the elastomeric material reaches over a pair of ribs 50, 51 of the top plate 10 along the aforementioned ends thereof. The ribs or ridges 50, 51 have redisued edges 52, 53 and concave curved transitions 54, 55 with troughs 56, 57 between these ridges and the formations 40 and 41 which receive members securing a rail to a coated platform 58 on the top plate 10.

As is also apparent from FIG. 2, the elastomer reaches around the radiused edges 52, 53, over the ridges 50 and 51 and onto the concave transitions 54, 55, to terminate in the troughs 56 and 57. The terminations of the elastomer in the troughs are along planar surfaces parallel to the surface 11*a*.

In addition, the elastomer reaches at 59 over the radiused edge 60 of the frame running into the flank 17 and terminates at a shoulder 61 along the outer surface of the frame.

The surfaces 14*a* and 15*a* of the longitudinal sides or member 14 and 15 of the frame confront downwardly extending flanges 23 and 24 of the top plate to define gaps 21 and 22 therewith. These gaps have practically parallel walls and receive elastomer fillings 32 and 33 which, over the lengths of the longitudinal sides of the top plate 10, have voids or crevices 62, 63 opening downwardly.

Figure 6:
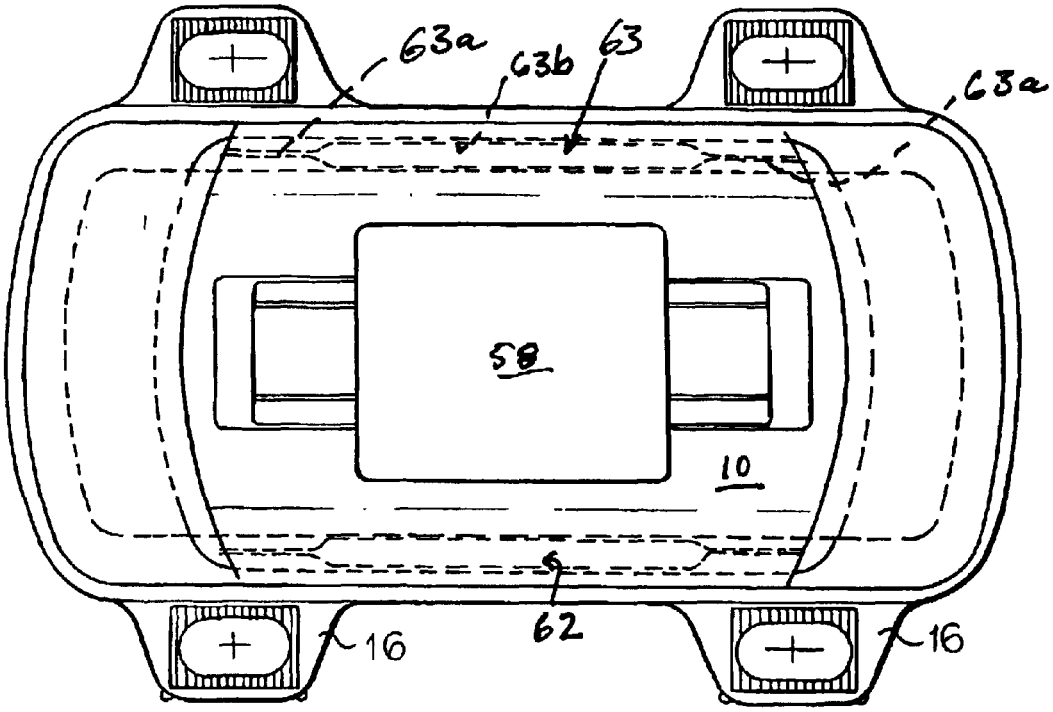
FIG. 6 is a view similar to that of FIG. 1 but showing the border between the elastomer and the metal in greater detail.

These crevices are shown in dot dash lines at 62, 63 in FIG. 6. From FIG. 6 it will be apparent that toward the ends of the top plate 10, the crevices or voids 62, 63 are narrow as will be apparent from FIG. 4. The narrow portion is seen at 63*a* in FIG. 6. However, at a midportion of each of the crevices or voids, e.g. the portion 63*b*, the void can be relatively wide (see FIG. 3).

The formations 40 and 41 which serve to hold the rail can be tubular bushes.

The system ensures that vertical and lateral loads are supported at the ends of the assembly only, an important feature of the invention. The elastomer used can be rubber, neoprene or mixtures thereof and the hardness or stiffness and thickness can be generated depending upon the vertical and lateral loads. The outboard ends can take the bulk of the load and after a certain sidewise deflection, the narrower voids can close restricting further deflection.

The load is taken primarily in close proximity to the anchor bolts where the body is especially strong.

I claim:

1. A rail mounting assembly comprising:

an elongated metal frame having a generally planar bottom surface adapted to rest upon a support, a pair of outwardly convex curved end members and a pair of mutually parallel longitudinal members, said members surrounding an opening of said frame, said end members having downwardly and inwardly inclined flanks delimiting said opening, said longitudinal members having flanks generally perpendicular to said bottom surface delimiting said opening;

an elongated top plate received in said opening in said frame and having an upper surface forming a platform for receiving a rail and formations flanking said platform for securing said rail on said platform, said top plate having a pair of outwardly convex curved ends spacedly juxtaposed with said end members and a pair of longitudinal sides spacedly juxtaposed with said longitudinal members, said ends having downwardly and inwardly inclined flanks forming respective gaps widening upwardly and downwardly with said downwardly and inwardly inclined flanks of said end members, said longitudinal sides having flanks defining respective gaps with the flanks of said longitudinal members; and a body of an elastomer received in said gaps, bonded to and fully covering said flanks and resiliently holding said frame and top plate together.

2. The rail mounting assembly defined in claim 1 wherein the elastomer in the gaps between said flanks of said longitudinal sides of said top plate and the flanks of said longitudinal members of said frame have downwardly open crevices extending the full lengths of said longitudinal sides.

3. The rail mounting assembly defined in claim 2 wherein said crevices are narrower toward ends of said longitudinal sides that at middle portions thereof.

4. The rail mounting assembly defined in claim 1 wherein said top plate at each of said ends has an upwardly projecting ridge spaced by a valley from said platform and said formations, said ridges having radiused transitions to the respective flanks at said ends and curved concave transitions to said valleys, said elastomer extending from the gaps between said downwardly and inwardly inclined flanks at said ends and said downwardly and inwardly inclined flanks of said end members over said radiused transitions.

5. The rail mounting assembly defined in claim 4 wherein said elastomer extends onto said curved concave transitions to said valleys.

6. The rail mounting assembly defined in claim 1 wherein said end members of said frame have radiused upper edges adjoining the gaps between said downwardly and inwardly inclined flanks at said ends and said downwardly and inwardly inclined flanks of said end members, said elastomer extending over said edges.

7. The rail mounting assembly defined in claim 1 wherein the elastomer in said gaps between said downwardly and inwardly inclined flanks at said ends and said downwardly and inwardly inclined flanks of said end members is outwardly concave at the top and bottom.

8. The rail mounting assembly defined in claim 7 wherein the elastomer in the gaps between said flanks of said longitudinal sides of said top plate and the flanks of said longitudinal members of said frame have downwardly open crevices extending the full lengths of said longitudinal sides.

9. The rail mounting assembly defined in claim 8 wherein said crevices are narrower toward ends of said longitudinal sides than at middle portions thereof.

10. The rail mounting assembly defined in claim 9 wherein said top plate at each of said ends has an upwardly projecting ridge spaced by a valley from said platform and said formations, said ridges having radiused transitions to the respective flanks at said ends and curved concave transitions to said valleys, said elastomer extending from the gaps between said downwardly and inwardly inclined flanks at said ends and said downwardly and inwardly inclined flanks of said end members over said radiused transitions.

11. The rail mounting assembly defined in claim 10 wherein said elastomer extends onto said curved concave transitions to said valleys.

12. The rail mounting assembly defined in claim 1 wherein said end members of said frame have radiused upper edges adjoining the gaps between said downwardly and inwardly inclined flanks at said ends and said downwardly and inwardly inclined flanks of said end members, said elastomer extending over said edges.

13. A rail mounting assembly comprising:

a metal frame;

a plate received in said metal frame and formed with a surface to which a rail can be secured; and a body of an elastomer extending all around said plate and bonded to said plate and said frame, said body being formed with voids in the forms of downwardly open crevices distributed between a periphery of said body and said frame, said voids opening and closing in response to forces between said plate and said frame and controlling distribution of load to said frame, said frame having a pair of opposite longitudinal members and said plate having flanks generally parallel to said longitudinal members and spaced from said members across longitudinal gaps, said body bridging said gaps, said crevices being provided in said body in said gaps and extending substantially the full lengths of said flanks.

14. The rail mounting assembly defined in claim 13 wherein said crevices are each wider at a middle portion and narrower at end portions thereof.

* * * * *